United States Patent [19]

Brownlie

[11] Patent Number: 4,465,319

[45] Date of Patent: Aug. 14, 1984

[54] INTEGRATED CUTTER, BREAKER AND HAULAGE DRIVE GEARCASE

[75] Inventor: James Brownlie, Overtown, Scotland

[73] Assignee: Anderson Strathclyde PLC, Glasgow, Scotland

[21] Appl. No.: 448,859

[22] PCT Filed: Feb. 22, 1982

[86] PCT No.: PCT/GB82/00058

§ 371 Date: Dec. 8, 1982

§ 102(e) Date: Dec. 8, 1982

[87] PCT Pub. No.: WO82/03654

PCT Pub. Date: Oct. 28, 1982

[30] Foreign Application Priority Data

Apr. 23, 1981 [GB] United Kingdom ..... 8002596

[51] Int. Cl.[3] ..... E21C 25/10

[52] U.S. Cl. ..... 299/42; 299/54

[58] Field of Search ..... 299/42, 43, 53, 54

[56] References Cited

U.S. PATENT DOCUMENTS 4,155,598 5/1979 Parrott et al. ..... 299/43

4,155,599 5/1979 Groger et al. ..... 299/43

FOREIGN PATENT DOCUMENTS 2306801 8/1974 Fed. Rep. of Germany ..... 299/43

2001685 2/1979 United Kingdom .

2004317 3/1979 United Kingdom .

2009819 6/1979 United Kingdom .

2060794 5/1981 United Kingdom ..... 299/42

1600470 11/1981 United Kingdom .

*Primary Examiner*—Ernest R. Purser

*Assistant Examiner*—Mark J. DelSignore

*Attorney, Agent, or Firm*—Mason, Fenwick & Lawrence

[57] ABSTRACT

A longwall coal-mining machine has a gearcase at each of its ends, each gearcase carrying two ranging arms respectively mounting a cutter drum and a lump breaker, and also carrying a haulage drive. Each gearcase comprises a casing having therein first and second co-axial and mutually-spaced transverse horizontal shafts projecting through opposite sides of the casing driven by individual transmissions located in the gearcase and from an electric motor and a hydraulic motor, respectively, both outside the casing. Rotation of the second shaft drives the mining machine along a longwall face. Rotation of the first shaft actuates a cutter drum through a gear train and also actuates a lump breaker through a gear transmission.

2 Claims, 2 Drawing Figures

INTEGRATED CUTTER, BREAKER AND HAULAGE DRIVE GEARCASE

TECHNICAL FIELD

This invention relates to longwall coal-mining machines, and more especially to gear-cases for incorporation in such machines.

BACKGROUND ART

On a mining machine of the drum cutter type for extracting coal on the longwall principle there are three drives which are provided in current practice, especially where the mining machine is equipped to travel on top of, and be guided and supported by, a flexible armoured scraper conveyor which is laid along the working face.

These are:

1. The drive to the cutting means, i.e. the cutter drum.
2. The drive to the means for hauling the machine along the longwall face, i.e. along the armoured face conveyor.
3. The drive to the means for breaking up large lumps of coal which have been dropped or been guided on to the face conveyor during the cutting operation and which are required to pass below the mining machine body on their way to the ends of the coal face for subsequent transport to the surface.

As is well known, the positions of the cutting drum and the lump breaker are at the extremities of the machine.

The positions of the haulage drive output sprocket varies dependent on whether the haulage system is by a round link chain stretched along the face or whether the system is "chainless", i.e. rack and pinion, peg and sprocket or trapped round link chain sprocket. An example of the "chainless" system is shown in our U.K. Pat. No. 1,521,687.

If the haulage drive is via a round link chain stretched along the face, the machine haulage drive sprocket is usually positioned on the side of the machine approximately midway along its length. In the case of "chainless" drives, however, it is necessary to have the haulage drive sprocket mounted on or adjacent to the support shoes by which the machine rests on the armoured face conveyor so that undulations on the floor do not affect the pitch relationship which the sprocket has to its mating drive element secured to the armoured face conveyor. It so happens that it is also good practice to have the support shoes as close to the cutting element as possible because it is by these shoes that the machine is trapped to the armoured face conveyor and kept from rising due to the reaction force from the cutting means.

In many applications the seam height is fairly high and there is an optimum condition of choice between the cutting drum diameter, the ranging arm length and the height of under frame placed between the mining machine body and the armoured face conveyor to achieve the seam height to be cut. This condition allows the use of a lump breaker and a chainless haulage system, the latter being secured to the extremities of the under frame. However, for lower seams where the under frame height is such that it precludes the use of the latter as a means of locating and securing the "chainless" haulage drive unit, the unit is then secured to the end faces at the extremities of the mining machine and therefore precludes the use of a lumpbreaker mechanism which would normally occupy this position.

DISCLOSURE OF INVENTION

It is the object of the invention to overcome the problem by providing a mining machine gearcase, which provides a lump breaker transmission drive branch from the cutter drum transmission drive within the gearcase in such a manner that the haulage drive elements can be housed within and on the side of the mining machine.

In accordance with the present invention, we provide a mining machine gearcase comprising a rectangular casing having therein intermediate the ends thereof first and second co-axial and mutually-spaced transverse horizontal shafts projecting through opposite sides of the casing and adapted rotatably to be driven by way of transmissions individual thereto from an electric motor and a hydraulic motor, respectively, both outside of the casing, the former being positioned to one end of the casing and the latter to one side of the casing and between said one end and said second shaft, the second shaft rotation being adapted to be utilised for driving means for hauling the mining machine along a longwall face and the first shaft rotation being adapted to be utilised to actuate, through a gear train at the other side of the casing, a cutter drum external to the other end of the casing, and also to actuate, through a gear transmission having an interposed clutch and disposed within the casing between the first shaft and said other end of the casing and a first stage of which is a gear wheel fast with and centered on the first shaft intermediate its length, means also external to said other end of the casing for breaking up large lumps of coal which have dropped during a cutting operation, the clutch being operable from outside of the casing.

Also in accordance with the present invention, we provide a longwall coal-mining machine comprising at opposite ends thereof a cutter drum mounted on a ranging arm carried by a gearcase, a lump breaker mounted on a ranging arm also carried by said gearcase and a haulage drive means also carried by said gearcase, each gearcase having the features defined in the preceding paragraph.

BRIEF DESCRIPTION OF DRAWINGS

An embodiment of the present invention will now be described, by way of example, with reference to the accompanying drawing .

BEST MODE OF CARRYING OUT THE INVENTION

Figure 1:
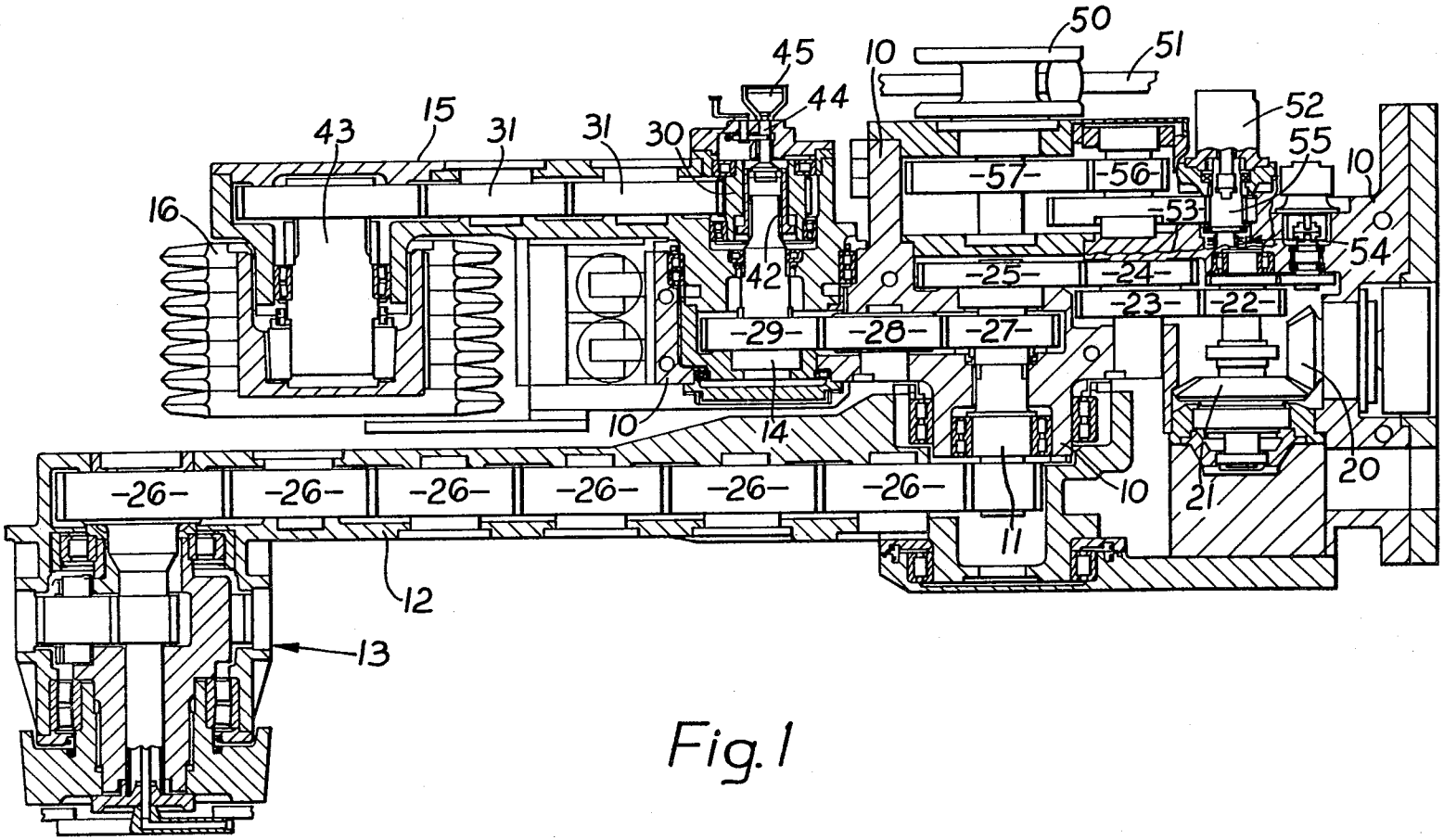
FIG. 1 is a sectional plan view of a gearcase at one end of a longwall mining machine embodying my invention.

The gearcase shown in the drawing includes a generally rectangular casing 10 having a central transverse drive shaft 11 which is journalled at one side of the casing, into the ranging arm 12 for a cutter drum (not shown) at 13. A second transverse drive shaft 14 located towards the outer end of the casing is journalled, at the other side of the casing, into the ranging arm 15 for a lump breaker 16.

A single transmission is provided to drive both cutter drum at 13 and lump breaker 16. The transmission receives power from an electric motor located between the ends of the machine and comprises a series of gears 20–25 which produces a rotation of the central shaft 11. The drive terminates in a train of gears 26 which carry power to the cutter drum at 13.

A transmission branch branches off from the drive shaft 11 in the form of a train of gears 27–30 by which power is transmitted to a clutch sleeve 42 around the outer end of transverse shaft 14. This branch drive terminates in a further train of gears 31 which carry power to an axle 43 onto which the lump breaker head is removably mounted.

A clutch 44 is provided aligned with said clutch sleeve 42 to couple the shaft 14 to gear 30 to drive gears 31 when the lump breaker is to be used; the clutch has a handle 45 operable externally of the gearbox. The clutch is shown engaged.

Another feature of the gearcase is the location thereon of the haulage drive wheel 50, located on the same side as the lump breaker ranging arm 15 but inwardly thereof, i.e. nearer to the central part of the machine than the ranging arm. The rack 51 which engages the line pan conveyor (not shown) is located below the drive wheel 50. The drive for the haulage drive wheel 50 is a hydraulic motor 52 mounted on the casing 10 inwards of the drive wheel 50 and on the same side of the casing as the drive wheel.

The transmission from the motor 52 to the drive wheel 50 is via a line located within the casing and incorporates a pinion shaft 55 engaging a spur gear wheel 53, via spur pinion and shaft 56 to spur gear and output shaft 57 connected to drive wheel 50. A plate-type friction clutch 54 is provided at the end of the input shaft 55 from the hydraulic motor 52 to act as a brake.

Thus, the casing for carrying the cutter drum and lump breaker also carries the haulage drive wheel and contains transmission means to drive all three items: cutter drum, lump breaker and haulage drive.

Figure 2:
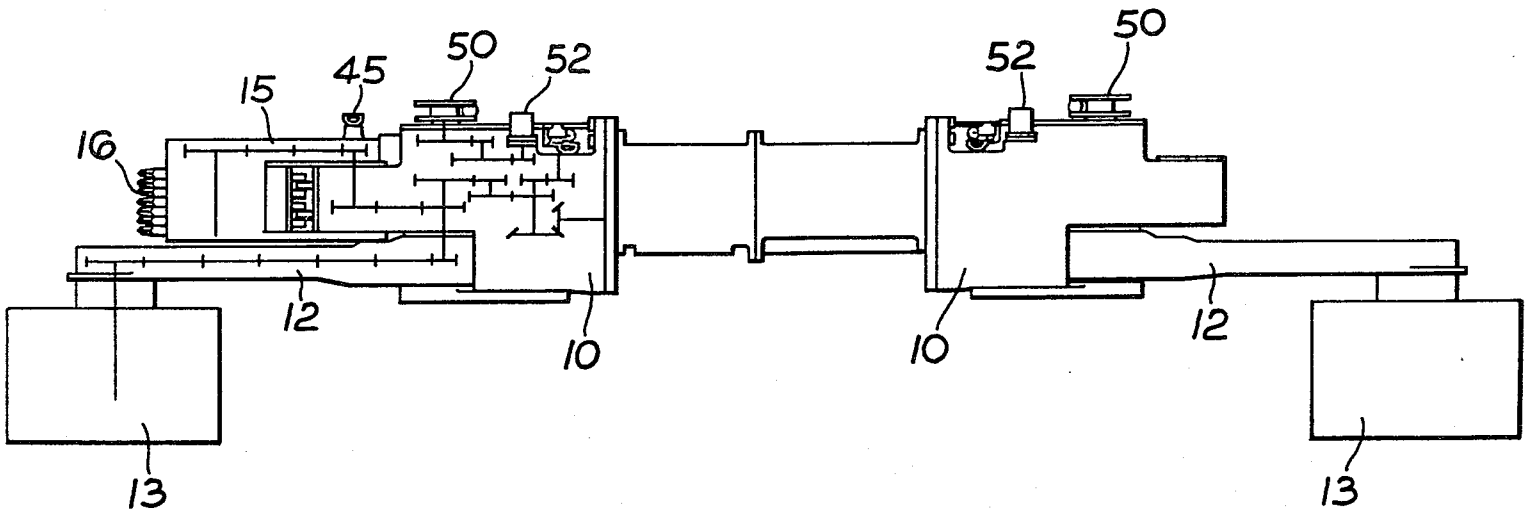
FIG. 2 is a plan view of a longwall mining machine having at each end a gearcase as illustrated in FIG. 1.

FIG. 2 illustrates a longwall mining machine having a gearcase 10 as hereinbefore described at each end. Each gearcase carries a ranging arm 12 mounting a cutter drum 13 and also a haulage drive 50, and one gearcase, namely the one at the forward end of the machine also carries a ranging arm 15 mounting a lump breaker. The gearing is illustrated in only one of the gearcases.

INDUSTRIAL APPLICABILITY

The provision of a gearcase having the features hereinbefore described enables the use of the lump breaker for both high and low seams because the haulage drive is mounted on the side of the gearcase and not on the end faces at the extremities of the machine as was previously necessary for use in low seams.

I claim:

1. A mining machine gearcase comprising a rectangular casing having therein intermediate the ends thereof first and second co-axial and mutually-spaced transverse horizontal shafts projecting through opposite sides of the casing and adapted rotatably to be driven by way of transmissions individual thereto from an electric motor and a hydraulic motor, respectively, both outside of the casing, the former being positioned to one end of the casing and the latter to one side of the casing and between said one end and said second shaft, and the first shaft rotation being adapted to be utilised to actuate, through a gear train at the other side of the casing, a cutter drum external to the other end of the casing, and also to actuate, through a gear transmission having an interposed clutch and disposed within the casing between the first shaft and said other end of the casing and a first stage of which is a gear wheel fast with and centered on the first shaft intermediate its length, means also external to said other end of the casing for breaking up large lumps of coal which have dropped during a cutting operation, the clutch being operable from outside of the casing.

2. A longwall coal mining machine comprising a gearcase as claimed in claim 1 at each of the opposite ends of the machine, each gearcase carrying a ranging arm mounting a cutter drum and also carrying a haulage drive, and having means to carry a ranging arm mounting a lump breaker at that end of the machine acting as the forward end.

* * * * *